US010533413B2

(12) United States Patent
Logan et al.

(10) Patent No.: US 10,533,413 B2
(45) Date of Patent: Jan. 14, 2020

(54) METHOD AND APPARATUS FOR DETERMINING ROTOR POSITION IN A FLUID PRESSURE PULSE GENERATOR

(71) Applicant: Evolution Engineering Inc., Calgary, Alberta (CA)

(72) Inventors: Justin C. Logan, Calgary (CA); Aaron W. Logan, Calgary (CA)

(73) Assignee: Evolution Engineering Inc., Calgary, Alberta (CA)

( * ) Notice: Subject to any disclaimer, the term of this patent is extended or adjusted under 35 U.S.C. 154(b) by 330 days.

(21) Appl. No.: 15/549,809

(22) PCT Filed: Feb. 9, 2016

(86) PCT No.: PCT/CA2016/050120

§ 371 (c)(1),
(2) Date: Aug. 9, 2017

(87) PCT Pub. No.: WO2016/127252

PCT Pub. Date: Aug. 18, 2016

(65) Prior Publication Data

US 2018/0045035 A1 Feb. 15, 2018

Related U.S. Application Data

(60) Provisional application No. 62/114,400, filed on Feb. 10, 2015.

(51) Int. Cl.

| | |
|---|---|
| ***E21B 47/09*** | (2012.01) |
| ***E21B 47/14*** | (2006.01) |
| ***E21B 47/18*** | (2012.01) |

(52) U.S. Cl.

CPC ..... *E21B 47/09* (2013.01); *E21B 47/14* (2013.01); *E21B 47/18* (2013.01)

(58) Field of Classification Search

CPC ..... E21B 47/09; E21B 47/14; E21B 47/18
See application file for complete search history.

(56) References Cited

U.S. PATENT DOCUMENTS

| | | | |
|---|---|---|---|
| 4,493,200 | A | 1/1985 | Rhoades |
| 4,562,559 | A | 12/1985 | Sharp et al. |

(Continued)

FOREIGN PATENT DOCUMENTS

| | | | |
|---|---|---|---|
| CA | 2463354 | A1 | 10/2005 |
| CA | 2894621 | | 6/2014 |

(Continued)

OTHER PUBLICATIONS

International Search Report and Written Opinion dated Apr. 27, 2016 for related PCT application No. PCT/CA2016/050120.

*Primary Examiner* — Ian J Lobo
(74) *Attorney, Agent, or Firm* — D'Ambrosio & Menon, PLLC; Usha Menon

(57) ABSTRACT

A method for determining a rotational position of a rotor in a fluid pressure pulse generator of a downhole telemetry tool comprises: for at least one rotational position of the rotor, determining an expected pressure of a drilling fluid at the fluid pressure pulse generator that corresponds to the at least one rotational position; forming a rotor position map of rotor rotational positions and corresponding expected drilling fluid pressures from the at least one rotational position of the rotor and the corresponding determined expected pressure; measuring a pressure of the drilling fluid at the fluid pressure pulse generator, and determining the rotational position of the rotor at the measured pressure by associating the measured pressure to an expected pressure and corresponding rotor rotational position in the rotor position map.

17 Claims, 15 Drawing Sheets

(56) References Cited

U.S. PATENT DOCUMENTS

| | | | |
|---|---|---|---|
| 4,764,711 | A | 8/1988 | Deller |
| 5,115,415 | A | 5/1992 | Mumby et al. |
| 5,140,245 | A | 8/1992 | Stacey |
| 5,333,686 | A | 8/1994 | Vaughan et al. |
| 5,375,098 | A | 12/1994 | Malone et al. |
| 5,384,527 | A | 1/1995 | Rozman et al. |
| 5,461,293 | A | 10/1995 | Rozman et al. |
| 5,493,163 | A | 2/1996 | Nishikawa |
| 5,495,162 | A | 2/1996 | Rozman et al. |
| 5,696,430 | A | 12/1997 | Erdman et al. |
| 5,747,971 | A | 5/1998 | Rozman et al. |
| 6,016,288 | A | 1/2000 | Frith |
| 6,023,658 | A | 2/2000 | Jeffryes |
| 6,104,113 | A | 8/2000 | Beifus |
| 6,469,637 | B1 | 10/2002 | Seyler et al. |
| 6,714,138 | B1 | 3/2004 | Turner et al. |
| 6,750,783 | B2 | 6/2004 | Rodney |
| 6,837,332 | B1 | 4/2005 | Rodney |
| 7,262,569 | B2 | 8/2007 | Douglas |
| 7,564,741 | B2 | 7/2009 | Pratt et al. |
| 7,567,047 | B2 | 7/2009 | Rozman |
| 7,577,545 | B2 * | 8/2009 | Hu ..... H02P 21/06 702/147 |
| 7,638,959 | B2 | 12/2009 | Rozman et al. |
| 7,940,192 | B2 | 5/2011 | Reckman et al. |
| 2007/0229004 | A1 | 10/2007 | Fukamizu et al. |
| 2008/0180273 | A1 | 7/2008 | Kyle et al. |
| 2013/0088361 | A1 | 4/2013 | Pike |

FOREIGN PATENT DOCUMENTS

| | | | |
|---|---|---|---|
| CA | 2900592 | | 9/2014 |
| EP | 0675590 | A1 | 10/1995 |
| EP | 1978631 | A1 | 10/2008 |
| EP | 2595307 | A2 | 5/2013 |
| GB | 2443415 | | 5/2008 |
| WO | 2009/001291 | A2 | 12/2008 |

* cited by examiner

METHOD AND APPARATUS FOR DETERMINING ROTOR POSITION IN A FLUID PRESSURE PULSE GENERATOR

FIELD

This disclosure relates generally to a method and apparatus for determining rotor position in a fluid pressure pulse generator of a downhole telemetry tool, such as a mud pulse telemetry tool.

BACKGROUND

The recovery of hydrocarbons from subterranean zones relies on the process of drilling wellbores. The process includes drilling equipment situated at surface, and a drill string extending from the surface equipment to a below-surface formation or subterranean zone of interest. The terminal end of the drill string includes a drill bit for drilling (or extending) the wellbore. The process also involves a drilling fluid system, which in most cases uses a drilling fluid ("mud") that is pumped through the inside of piping of the drill string to cool and lubricate the drill bit. The mud exits the drill string via the drill bit and returns to surface carrying rock cuttings produced by the drilling operation. The mud also helps control bottom hole pressure and prevent hydrocarbon influx from the formation into the wellbore, which can potentially cause a blow out at surface.

Directional drilling is the process of steering the drilling of a well from vertical to intersect a target endpoint or follow a prescribed path. At the terminal end of the drill string is a bottom-hole-assembly ("BHA") which comprises 1) the drill bit; 2) a steerable downhole mud motor of a rotary steerable system; 3) sensors of survey equipment used in logging-while-drilling ("LWD") and/or measurement-while-drilling ("MWD") to evaluate downhole conditions as drilling progresses; 4) means for telemetering data to surface; and 5) other control equipment such as stabilizers or heavy weight drill collars. The BHA is conveyed into the wellbore by a string of metallic tubulars (i.e. drill pipe). MWD equipment is used to provide downhole sensor and status information to surface while drilling in a near real-time mode. This information is used by a rig crew to make decisions about controlling and steering the well to optimize the drilling speed and trajectory based on numerous factors, including lease boundaries, existing wells, formation properties, and hydrocarbon size and location. The rig crew can make intentional deviations from the planned wellbore path as necessary based on the information gathered from the downhole sensors during the drilling process. The ability to obtain real-time MWD data allows for a relatively more economical and more efficient drilling operation.

One type of downhole telemetry known as mud pulse telemetry involves creating pressure waves ("pulses") in the mud circulating through the drill string. Mud is circulated from surface to downhole using positive displacement pumps. The pressure pulses are created by a fluid pressure pulse generator in a downhole telemetry tool, which controllably changes the flow area and/or path of the mud as it passes through the pulse generator in a timed, coded sequence, thereby creating pressure differentials in the mud. The changes in flow area can be effected by a valve mechanism in the pulse generator. One such valve mechanism is a rotor and stator combination, wherein the rotor is coupled to a motor which is controlled to rotate the rotor relative to the stator between an opened position where there is no restriction of mud flowing through the valve and no pulse is generated, and a restricted flow position where there is restriction of mud flowing through the valve and a pressure pulse is generated.

The position of the rotor at any given time is conventionally determined by position sensors typically located on an output side of the motor. Such sensors can be prone to failure, and impose an expense and complexity to the downhole tool. However, determining the rotor position is important in order to ensure that the telemetry signal is corrected encoded; a misaligned rotor can cause errors in the encoded telemetry signal, or make it difficult or impossible to decode the telemetry signal at surface. Therefore, it is desirable to provide a new and useful method or apparatus for determining the rotor position in a fluid pressure pulse generator.

SUMMARY

According to one aspect of the invention, there is provided a method for determining a rotational position of a rotor in a fluid pressure pulse generator of a downhole telemetry tool. The method comprises the following steps: For at least one rotational position of the rotor, an expected pressure of a drilling fluid at the fluid pressure pulse generator that corresponds to the at least one rotational position is determined. Then, a rotor position map of rotor rotational positions and corresponding expected drilling fluid pressures from the at least one rotational position of the rotor and the corresponding determined expected pressure is formed. A pressure of the drilling fluid at the fluid pressure pulse generator is measured, and the rotational position of the rotor at the measured pressure is then determined by associating the measured pressure to an expected pressure and corresponding rotor rotational position in the rotor position map.

The at least one rotational position can comprise a fully opened flow position, in which case the corresponding expected pressure is the lowest pressure generated by the fluid pressure pulse generator. Alternatively or additionally, the at least one rotational position can comprise a maximum restricted flow position, in which case the corresponding expected pressure is the highest pressure generated by the fluid pressure pulse generator.

Assuming the determined rotational position of the rotor is at a first rotor position, the method can further comprise rotating the rotor towards a second rotor position that is expected to increase drilling fluid flow thereby reducing the expected pressure of the drilling fluid, then measuring the pressure of the drilling fluid at the second rotor position and identifying a rotor misalignment when the measured pressure at the second rotor position is not lower than the measured pressure at the first rotor position. Alternatively, the method can further comprise rotating the rotor towards a second rotor position that is expected to decrease drilling fluid flow thereby increasing the expected pressure of the drilling fluid, then measuring the pressure of the drilling fluid at the second rotor position and identifying a rotor misalignment when the measured pressure at the second rotor position is not higher than the measured pressure at the first rotor position. In either case, the fluid pressure pulse generator can be a single amplitude pulse generator configured to operate in a dual direction oscillation mode, in which case the fluid pressure profile comprises pulses of the same amplitude. Alternatively, the fluid pressure pulse generator can be a dual amplitude pulse generator configured to operate in a dual direction oscillation mode, in which case the fluid pressure profile comprises at least two pulses of different amplitudes.

Again assuming the determined rotational position of the rotor is at a first rotor position, the method can further comprise rotating the rotor towards a second rotor position that is expected to correspond to a maximum restricted flow position and produce a maximum drilling fluid pressure, then measuring the drilling fluid pressure as the rotor is rotated between the first and second rotor positions, and identifying a rotor misalignment when the measured pressure at the second rotor position is lower than the maximum drilling fluid pressure by a selected threshold.

The method can further comprise performing a calibration sweep operation to align the rotor with a motor coupled to the rotor when the rotor misalignment has been identified. The calibration sweep operation comprises: (a) rotating the motor through multiple incremental motor rotational positions and measuring the drilling fluid pressure at each incremental motor position thereby defining a fluid pressure profile across the multiple incremental motor positions; (b) determining a rotor rotational position corresponding to the measured drilling fluid pressure at each incremental motor rotational position, wherein the determined rotor rotational position is the expected rotor rotational position that produces the measured drilling fluid pressure; and (c) updating the rotor position map with the determined rotational positions and corresponding drilling fluid pressures and incremental motor rotational positions.

According to another aspect of the invention, there is provided a method for determining a rotor misaligned condition in a fluid pressure pulse generator of a downhole telemetry tool. This method comprises: (a) generating fluid pressure pulses of a known pulse pattern; (b) measuring a drilling fluid pressure at a first selected rotor position and a second selected rotor position in the known pulse pattern; and (c) identifying a rotor misaligned condition when the measured drilling fluid pressure change and an expected drilling fluid pressure change between the first and second selected rotor positions deviates beyond a selected threshold.

According to another aspect of the invention, there is provided a method for determining a reverse pulse condition in a fluid pressure pulse generator of a downhole telemetry tool. This method comprises: (a) measuring a drilling fluid pressure in the fluid pressure pulse generator when a rotor of the fluid pressure pulse generator is at a first rotor position; (b) rotating the rotor towards a fully opened position or towards a maximum restricted position until the rotor reaches a second rotor position, (c) measuring the fluid pressure in the fluid pressure pulse generator at the second rotor position; and (d) identifying a reverse pulse condition when (i) the measured fluid pressure increases from the first to second rotor positions when the rotor is rotated towards the fully opened position; or (ii) when the measured pressure decreases from the first to second rotor positions when the rotor is rotated towards the maximum restricted position.

According to yet another aspect of the invention, there is provided a downhole telemetry tool, comprising: a motor, a fluid pressure pulse generator, a pressure transducer and an electronics subassembly. The fluid pressure pulse generator comprises a stator and a rotor coupled to the motor and rotatable relative to the stator. The pressure transducer is configured to measure a pressure of a drilling fluid at the pulse generator. The electronics subassembly is communicative with the motor and the pressure transducer, and comprises a processor and a memory having program code encoded thereon that is executable by the processor to determine a position of the rotor. When executed, the program code performs the following steps: (i) for at least one rotational position of the rotor, determining an expected pressure of a drilling fluid at the fluid pressure pulse generator that corresponds to the at least one rotational position; (ii) forming a rotor position map of rotor rotational positions and corresponding expected drilling fluid pressures from the at least one rotational position of the rotor and the corresponding determined expected pressure; and (iii) reading a pressure measurement from the pressure transducer, and determining the rotational position of the rotor at the pressure measurement by associating the pressure measurement to an expected pressure and corresponding rotor rotational position in the rotor position map.

DETAILED DESCRIPTION OF EMBODIMENTS

Figure 1:
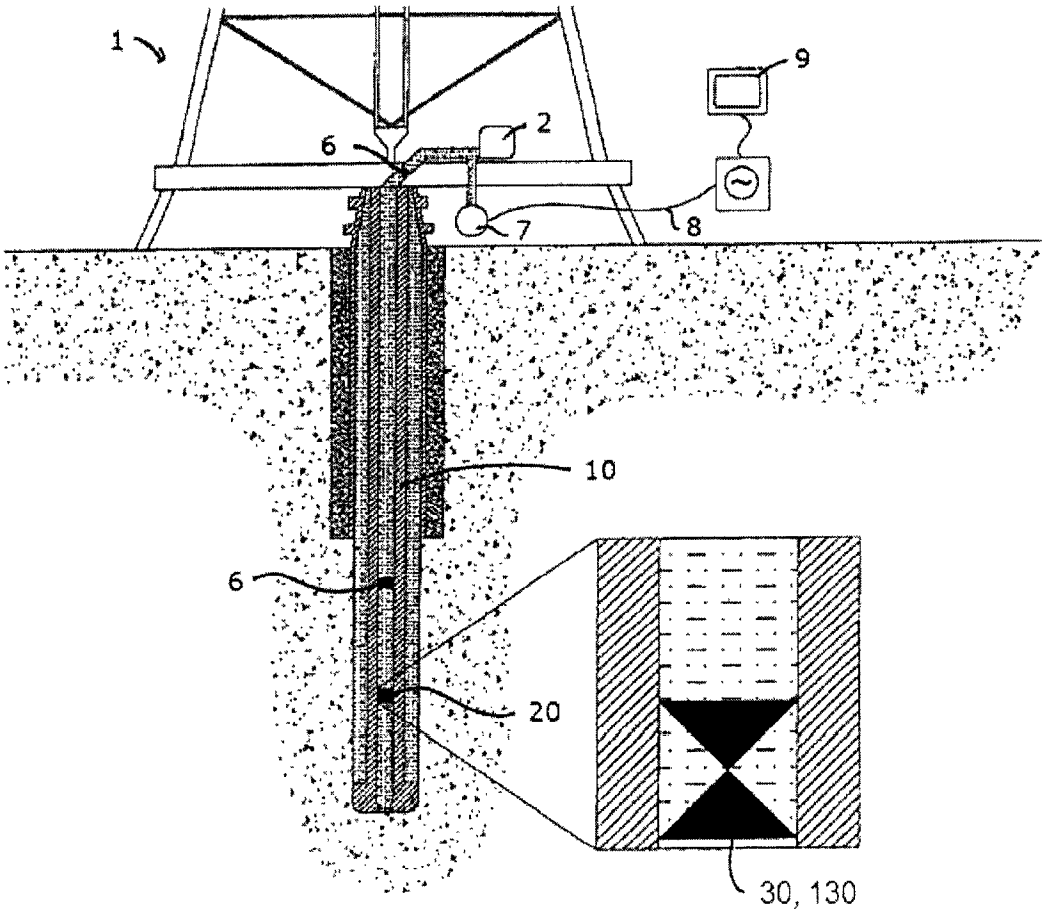
FIG. 1 is a schematic of a drill string in an oil and gas borehole comprising a downhole telemetry tool in accordance with embodiments of the invention.

Directional terms such as "uphole" and "downhole" are used in the following description for the purpose of providing relative reference only, and are not intended to suggest any limitations on how any apparatus is to be positioned during use, or to be mounted in an assembly or relative to an environment.

Overview

The embodiments described herein generally relate to a downhole telemetry tool having a fluid pressure pulse generator comprising a rotor and stator valve mechanism, and in particular, to a method and apparatus for detecting the rotational position of the rotor using drilling fluid pressure measurements. The fluid pressure pulse generator may be used for mud pulse ("MP") telemetry used in downhole drilling, wherein a drilling fluid ("mud") is used to transmit telemetry pulses to surface. In addition to the rotor, the fluid pressure pulse generator comprises a stator which is fixed to a pulser assembly of the downhole telemetry tool or to a drill collar housing of the downhole telemetry tool. The rotor is coupled to a driveshaft of a motor in the pulser assembly. The motor rotates the rotor relative to the stator between a fully opened position where there is no restriction of mud flowing through the fluid pressure pulse generator and thus no pulse is generated, and a maximum restricted flow position where there is a maximum restriction of mud flowing through the fluid pressure pulse generator and thus a pressure pulse of maximum amplitude is generated. The downhole telemetry tool further comprises a pressure transducer that measures the pressure of the drilling fluid at the fluid pressure pulse generator.

The rotor's rotational position can be aligned with the motor's rotational position using a calibration sweep program stored on a memory of the downhole telemetry tool. The calibration sweep program is executed by a processor in the downhole telemetry tool to perform a calibration sweep operation wherein the drilling fluid pressure is measured at multiple incremental positions of the motor to produce a fluid pressure profile across the multiple motor positions. The motor position at the lowest measured pressure is deemed to correspond to the rotor's fully opened position, and the motor position at the highest measured pressure is deemed to correspond to the rotor's maximum restricted position. Based on these end points, a rotor position is assigned to each measured pressure reading and its corresponding motor position. The fluid pressure profile and the associated rotor and motor positions are then stored on a rotor position map stored in the memory.

The calibration sweep program can be executed when the rotor becomes misaligned with the motor, and especially when the rotor position is so misaligned that a reverse pulse condition occurs where a maximum pressure pulse is measured when no pulse is expected and vice versa. A rotor misalignment can be detected by the downhole tool by rotating the motor to move the rotor towards the fully opened or maximum restricted flow position, and measuring the fluid pressure before and after the rotor has been moved. When the measured fluid pressure increases when the rotor is moved towards the fully opened flow position, a reverse pulse condition is determined; similarly, when the measured fluid pressure decreases when the rotor is moved towards the maximum restricted flow position, a reverse pulse condition is also determined. Alternatively, a rotor misalignment can be detected by reading pressure measurements from the pressure transducer while the pressure pulse generator is producing a known pulse pattern. The processor compares a measured pressure value at a specified motor position with the expected pressure value at that motor position, using the fluid pressure profile in the rotor position map. If the measured and expected pressure values deviate beyond a selected threshold or range, then the processor deems the rotor to be out of alignment and requiring realignment.

Downhole Telemetry Tool

Referring to FIG. 1, there is shown a schematic representation of a MP telemetry operation using a fluid pressure pulse generator. In downhole drilling equipment 1, drilling mud is pumped down a drill string by pump 2 and passes through a downhole telemetry tool 20. The downhole telemetry tool 20 includes a fluid pressure pulse generator 30. The fluid pressure pulse generator 30 has a maximum open position in which mud flows relatively unimpeded through the pressure pulse generator 30 and no pressure pulse is generated and a maximum restricted flow position where flow of mud through the pressure pulse generator 30 is maximally restricted and the peak of a positive pressure pulse is generated (represented schematically as block 6 in mud column 10). Information acquired by downhole sensors (not shown) is encoded by the downhole telemetry tool 20 into a telemetry signal and transmitted as a pattern of pressure pulses 6 in the mud column 10. More specifically, signals from sensor modules in the downhole telemetry tool 20, or in another downhole probe (not shown) communicative with the downhole telemetry tool 20, are received and processed in a data encoder in the downhole telemetry tool 20 where the data is digitally encoded as is well established in the art. This data is sent to a controller in the downhole telemetry tool 20 which then actuates the fluid pressure pulse generator 30 to generate pressure pulses 6 which contain the encoded data. The pressure pulses 6 are transmitted to the surface and detected by a surface pressure transducer 7 and decoded by a surface computer 9 communicative with the transducer by cable 8. The decoded signal can then be displayed by the computer 9 to a drilling operator. The characteristics of the pressure pulses 6 are defined by duration, shape, and frequency, and these characteristics are used in various encoding systems to represent binary data.

Figure 2A:
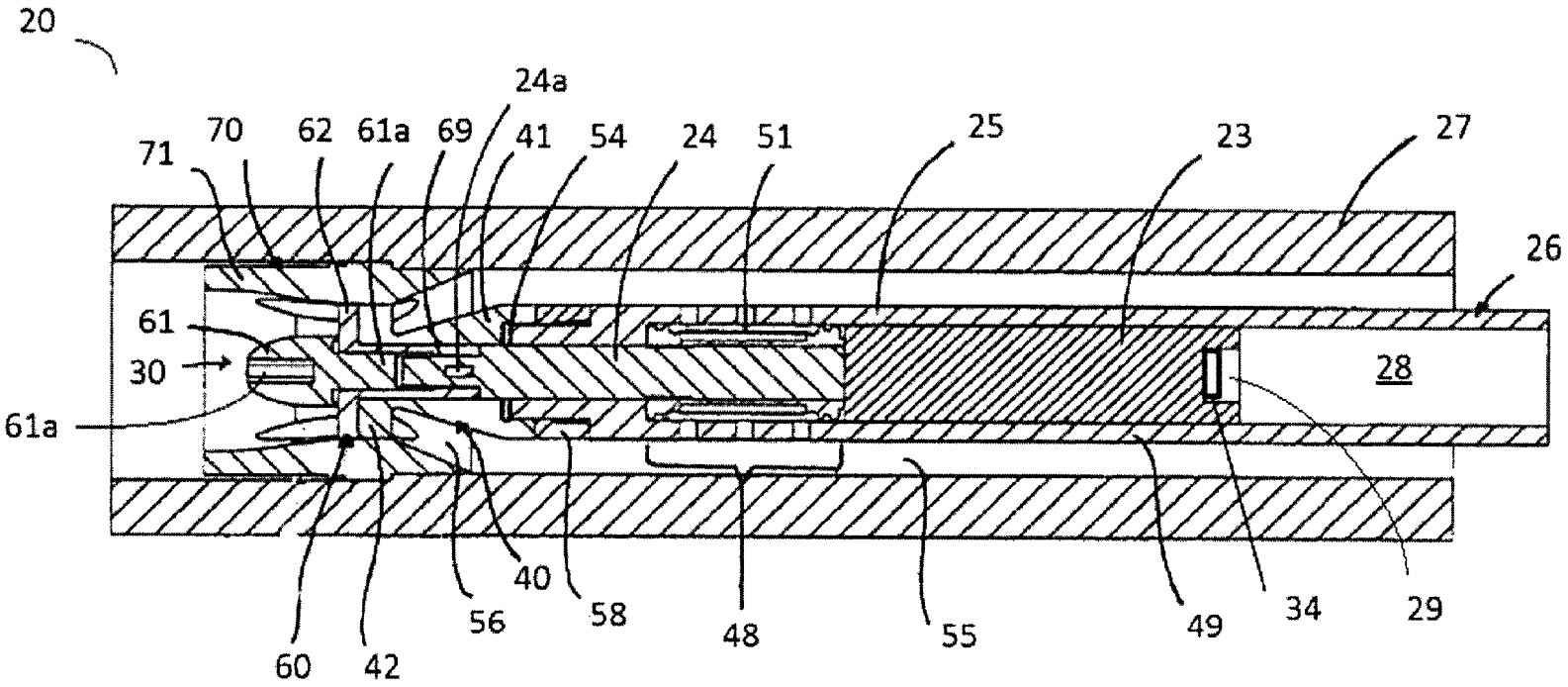
FIG. 2 is a longitudinally sectioned view of a mud pulser section of the downhole telemetry tool.

Referring to FIG. 2, the downhole telemetry tool 20 is shown in more detail. The downhole telemetry tool 20 generally comprises the fluid pressure pulse generator 30 which creates fluid pressure pulses, and a pulser assembly 26 which drives the fluid pressure pulse generator 30 and which optionally can take measurements while drilling. The fluid pressure pulse generator 30 and pulser assembly 26 are axially located inside a drill collar 27. A flow bypass sleeve 70 received inside the drill collar 27 surrounds the fluid pressure pulse generator 30. The pulser assembly 26 is fixed to the drill collar 27 with an annular channel 55 therebetween, and mud flows along the annular channel 55 when the downhole telemetry tool 20 is downhole. The pulser assembly 26 comprises a pulser assembly housing 49 enclosing a motor subassembly 25 and an electronics subassembly 28 electronically coupled together but fluidly separated by a feed-through connector 29. The motor subassembly 25 includes a motor and gearbox subassembly 23, a driveshaft 24 connected to the motor and gearbox subassembly 23, and a pressure compensation device 48. The fluid pressure pulse generator 30 comprises a stator 40 and a rotor 60 located inside the flow bypass sleeve 70. The stator 40 is fixed to the pulser assembly housing 49 and the rotor 60 is fixed to the driveshaft 24. Rotation of the driveshaft 24 by the motor and gearbox subassembly 23 rotates the rotor 60 relative to the fixed stator 40.

The fluid pressure pulse generator 30 is located at the downhole end of the downhole telemetry tool 20. Mud pumped from the surface by pump 2 flows along annular channel 55 between the outer surface of the pulser assembly 26 and the inner surface of the drill collar 27. When the mud reaches the fluid pressure pulse generator 30 it flows along an annular channel 56 provided between the external surface of the stator 40 and the internal surface of the flow bypass sleeve 70. The rotor 60 can rotate between an open position where mud flows freely through the fluid pressure pulse generator 30 resulting in no pressure pulse and a restricted flow position where flow of mud is restricted to generate pressure pulse 6.

The motor subassembly 25 is filled with a lubricating liquid such as hydraulic oil or silicon oil and this lubricating liquid is fluidly separated from mud flowing along the annular channel 55 by an annular seal 54 which surrounds the driveshaft 24. The pressure compensation device 48 comprises a flexible membrane 51 in fluid communication with the lubrication liquid on one side and with mud on the other side via ports 50 in the pulser assembly housing 49; this allows the pressure compensation device 48 to maintain the pressure of the lubrication liquid at about the same pressure as the mud at the fluid pressure pulse generator 30.

A pressure transducer 34 is mounted in the feed through connector 29 such that the pressure transducer 34 can measure the pressure of the lubrication liquid. Because the pressure of the lubrication liquid corresponds to the pressure of the drilling mud at the pulse generator 30, the pressure transducer 34 can be used to measure the pressure pulses 5, 6 generated by the pulse generator 30. As will be discussed below in more detail, these measurements can be used to provide useful data for the operator to determine the expected angular position of the rotor 60.

The electronics subassembly 28 includes downhole sensors, control electronics, and other components required by the downhole telemetry tool 20 to determine direction and inclination information and to take measurements of drilling conditions, to encode this telemetry data using one or more known modulation techniques into a carrier wave, and to send motor control signals to the motor and gearbox subassembly 23 to rotate the driveshaft 24 and rotor 60 in a controlled pattern to generate pressure pulses 6 representing the carrier wave for transmission to surface. Also, as will be described in more detail below, the electronics subassembly 28 comprises a processor and a memory having stored thereon a calibration sweep program that when executed by the processor will map the expected position of the rotor 60 to corresponding pressure measurements taken by the pressure transducer 34 during a calibration sweep operation, and store these measurements in a rotor position map. The memory can also optionally include a reverse pulse detection program that when executed by the processor will determine whether the rotor position is out of alignment by comparing a measured fluid pressure at an expected rotor position with an expected pressure at that expected rotor position, based on the fluid pressure-rotor position map.

Figure 3B:
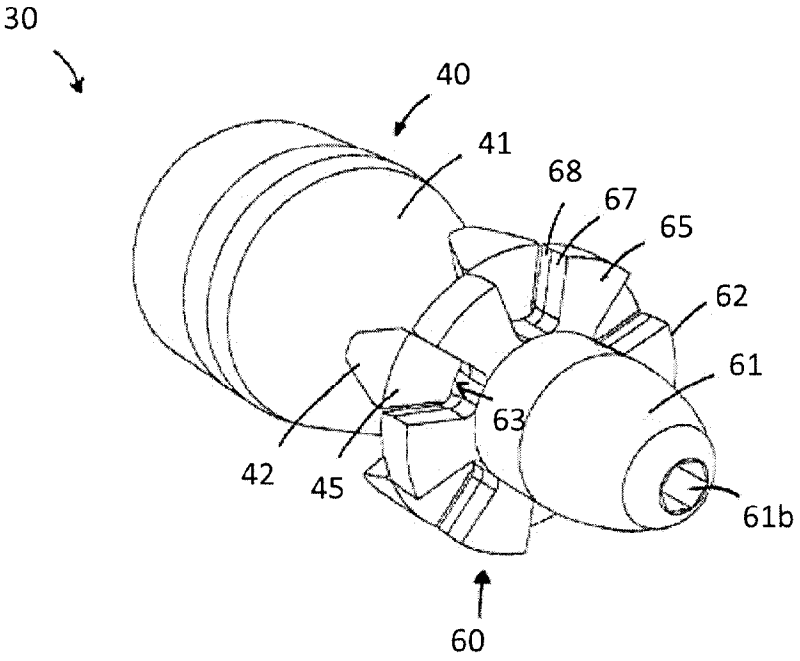
FIGS. 3(*a*) and (*b*) are rear and front perspective views of a first embodiment of a fluid pressure pulse generator of the downhole telemetry tool, wherein a rotor of the fluid pressure pulse generator is shown in a maximum restricted flow position.
Figure 3A:
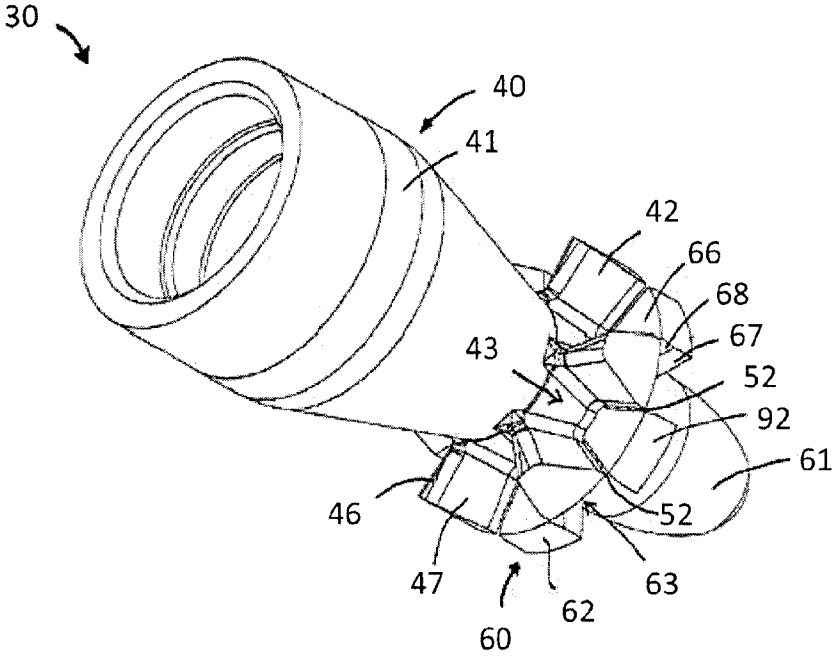
Figure 4:
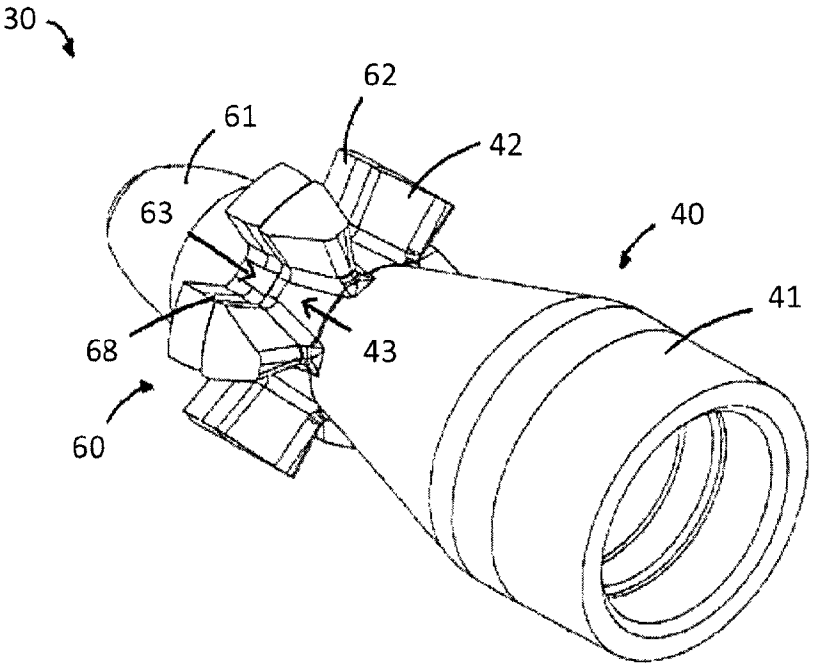
FIG. 4 is a rear perspective view of the first embodiment of the fluid pressure pulse generator, wherein the rotor is shown in a fully opened flow position.
Figure 5:
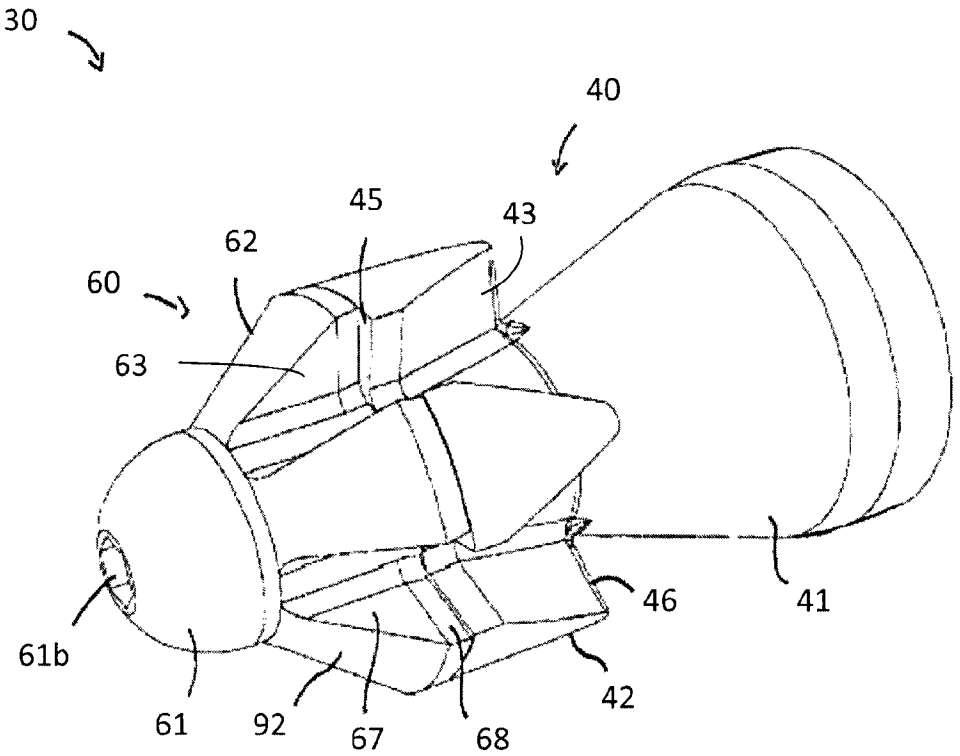
FIG. 5 is a rear perspective view of a second embodiment of a fluid pressure pulse generator, wherein a rotor of the fluid pressure pulse generator is shown in a fully opened flow position.
Figure 6A:
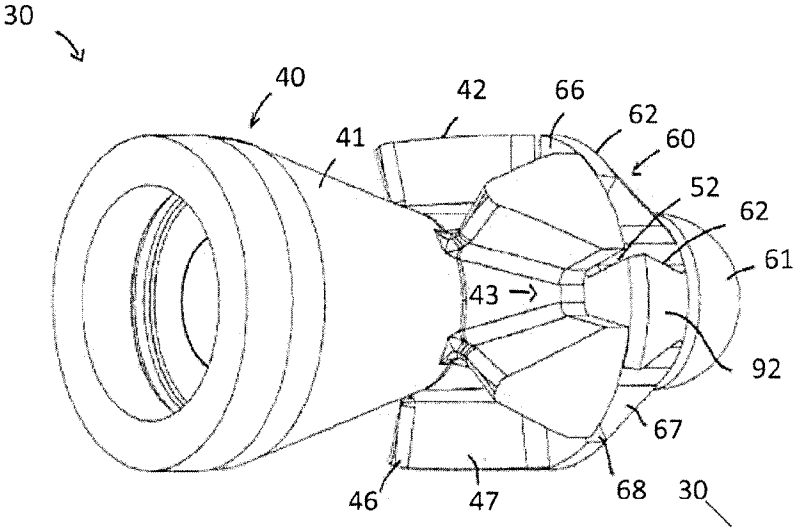
FIGS. 6(*a*) and (*b*) are rear perspective views of the second embodiment of the fluid pressure pulse generator with the rotor shown in an intermediate restricted flow position (FIG. 6(*a*)), and in a maximum restricted flow position (FIG. 6(*b*)).
Figure 6B:
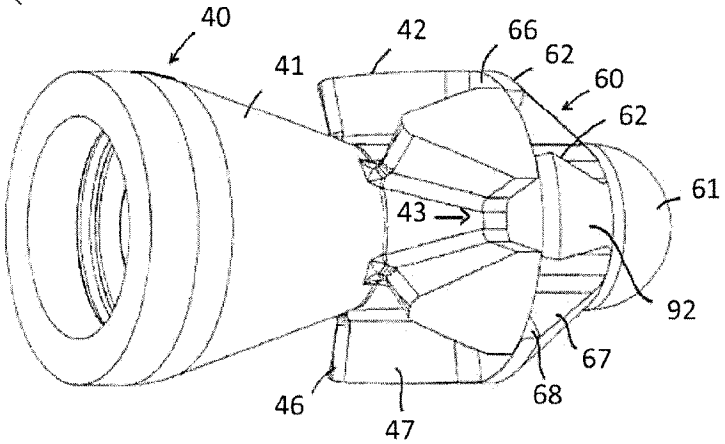
Figure 7:
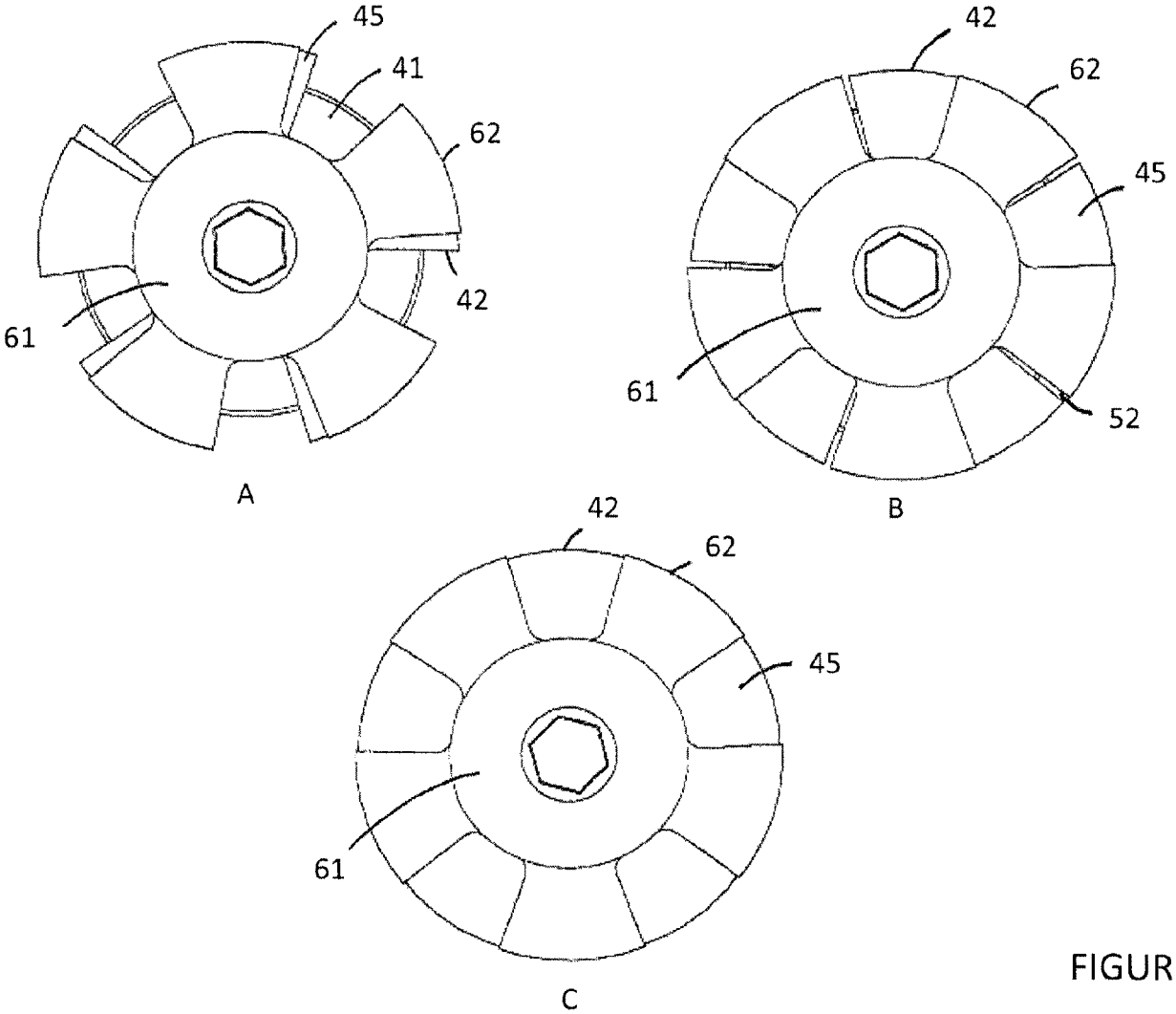
FIG. 7 are three end views of the second embodiment of the fluid pressure pulse generator, wherein the rotor is shown respectively, in the fully opened, intermediate restricted and fully restricted flow positions.

The fluid pressure pulse generator 30 can comprise a rotor/stator combination of different designs. One particular embodiment of a rotor/stator combination is shown in FIGS. 3 to 4 ("single pulse amplitude rotary vane pulser") and can generate pulses of the same pulse amplitude. Another embodiment of a rotor/stator combination is shown in FIGS. 5 to 7 ("dual pulse amplitude rotary vane pulser") and can generate pulses of two different pulse amplitude. Other suitable rotor/stator combinations would be apparent to one skilled in the art, and include a rotor/stator combination as disclosed in PCT applications no. PCT/CA2013/050843 and PCT/CA2013/050966.

Fluid Pressure Pulse Generator—Single Amplitude Embodiment

Referring now to FIGS. 3-4 and according to a first embodiment of the fluid pressure pulse generator 30, the stator 40 comprises a longitudinally extending stator body 41 with a central bore therethrough. The stator body 41 comprises a cylindrical section at the uphole end and a generally frusto-conical section at the downhole end which tapers longitudinally in the downhole direction. As shown in FIG. 2, the cylindrical section of stator body 41 is coupled with the pulser assembly housing 49. More specifically, a jam ring 58 threaded onto the pulser assembly housing 49 is threaded on the stator body 41. Once the stator 40 is positioned correctly, the stator 40 is held in place and the jam ring 58 is backed off and torqued onto the stator 40 holding it in place. The stator 40 surrounds annular seal 54. The external surface of the pulser assembly housing 49 is flush with the external surface of the cylindrical section of the stator body 41 for smooth flow of mud therealong.

A plurality of radially extending projections 42 are spaced equidistant around the downhole end of the stator body 41. Each stator projection 42 is tapered and narrower at its proximal end attached to the stator body 41 than at its distal end. The stator projections 42 have a radial profile with an uphole end or face 46 and a downhole end or face 45, with two opposed side faces 47 extending therebetween. A section of the radial profile of each stator projection 42 is tapered towards the uphole end or face 46 such that the uphole end or face 46 is narrower than the downhole end or face 45. The stator projections 42 have a rounded uphole end 46 and most of the stator projection 42 tapers towards the rounded uphole end 46.

Mud flowing along the external surface of the stator body 41 contacts the uphole end or face 46 of the stator projections 42 and flows through stator flow channels 43 defined by the side faces 47 of adjacently positioned stator projections 42. The stator flow channels 43 are curved or rounded at their proximal end closest to the stator body 41. The stator projections 42 and thus the stator flow channels 43 defined therebetween may be any shape and dimensioned to direct flow of mud through the stator flow channels 43.

The rotor 60 comprises a generally cylindrical rotor body 69 with a central bore therethrough and a plurality of radially extending projections 62. As shown in FIG. 2, the rotor body 69 is received in the bore of the stator body 41. A downhole shaft of the driveshaft 24 is received in uphole end of the bore of the rotor body 69 and a coupling key **24*a* extends through the driveshaft 24 and is received in a coupling key receptacle (not shown) at the uphole end of the rotor body 69 to couple the driveshaft 24 with the rotor body 69. A rotor cap comprising a cap body 61 and a cap shaft 61*a* is positioned at the downhole end of the fluid pressure pulse generator 30. The cap shaft 61***a* extends through the downhole end of the bore of the rotor body 69 and threads onto the downhole shaft of the driveshaft 24 to lock (torque) the rotor 60 to the driveshaft 24.

The radially extending rotor projections 62 are spaced equidistant around the downhole end of the rotor body 69 and are axially positioned downhole relative to the stator projections 42. The rotor projections 62 rotate in and out of fluid communication with the stator flow channels 43 to generate pressure pulse 6 as is described in more detail below. Each rotor projection 62 has a radial profile including an uphole end or face and a downhole end or face 65, with two opposed side faces 67 and an end face 92 extending between the uphole end or face and the downhole end or face 65. The rotor projections 62 taper from the end face 92 towards the rotor body 69 so that the rotor projections 62 are narrower at the point that joins the rotor body 69 than at the end face 92. Each side face 67 has a bevelled or chamfered uphole edge 68 which is angled inwards towards the uphole face such that an uphole section of the radial profile of each of the rotor projections 62 tapers in an uphole direction towards the uphole face.

In order to generate fluid pressure pulses 6 a controller (not shown) in the electronics subassembly 28 sends motor control signals to the motor and gearbox subassembly 23 to rotate the driveshaft 24 and rotor 60 in a controlled pattern using one of the following methods of rotation:

One direction clockwise-anticlockwise oscillation

The rotor 60 starts in the open position as shown in FIG. 4, where the rotor flow channels 63 align with the stator flow channels 43 and there is no pressure pulse. The rotor 60 then rotates clockwise to the restricted flow position as shown in FIGS. 3(*a*) and (*b*) where the rotor projections 62 align with the stator flow channels 43 and the flow of mud is restricted which generates pressure pulse 6. The rotor 60 then rotates anticlockwise back to the start (open) position where there is no pressure pulse. This clockwise-anticlockwise oscillation is repeated in a controlled pattern to generate pressure pulses 6.

One direction anticlockwise-clockwise oscillation

The rotor 60 starts in the open position as shown in FIG. 4 where the rotor flow channels 63 align with the stator flow channels 43 and there is no pressure pulse. The rotor 60 then rotates anticlockwise to the restricted flow position as shown in FIGS. 3(*a*) and (*b*), where the rotor projections 62 align with the stator flow channels 43 and the flow of mud is restricted which generates pressure pulse 6. The rotor 60 then rotates clockwise back to the start (open) position where there is no pressure pulse. This anticlockwise-clockwise oscillation is repeated in a controlled pattern to generate pressure pulses 6.

Dual direction oscillation

The rotor 60 starts in the open position as shown in FIG. 4, where the rotor flow channels 63 align with the stator flow channels 43 and there is no pressure pulse. The rotor can then rotate either clockwise or anticlockwise from the start (open) position to the restricted flow position shown in FIGS. 3(*a*) and (*b*), to generate pressure pulses 6, each time rotating back in the opposite direction to the same start (open) position before the next rotation in either the clockwise or anticlockwise direction.

Continuous one direction rotation

The rotor 60 rotates continuously in one direction (either clockwise or anticlockwise) moving between the open and restricted flow positions to generate pressure pulses 6. The direction of continuous rotation may be regularly changed to reduce wear caused by long term rotation in one direction only.

Fluid Pressure Pulse Generator—Dual Amplitude Pulse Generator

FIGS. 5 to 7 illustrate a second embodiment of the fluid pressure pulse generator 30 that is configured to generate pressure pulses having one of two possible pulse amplitudes, namely, a "maximum amplitude pressure pulse" and an "intermediate amplitude pressure pulse".

Like the first embodiment, the second embodiment of the pressure pulse generator 30 comprises radially extending rotor projections 62 that are spaced equidistant around the downhole end of the rotor body and are axially positioned adjacent to and downhole of the stator projections 42. The rotor projections 62 rotate in and out of fluid communication with the stator flow channels 43 to generate pressure pulses as is described in more detail below. Each rotor projection 62 has a radial profile including an uphole end (face) (not shown) and a downhole end, with two opposed side faces 67 and an end face 92 extending between the uphole end and the downhole end. The rotor projections 62 taper from the end face 92 towards the rotor body so that the rotor projections 62 are narrower at the point that joins the rotor body than at the end face 92. Each side face 67 has a bevelled or chamfered uphole edge 68 which is angled inwards towards the uphole face such that an uphole section of the radial profile of each of the rotor projections 62 tapers in an uphole direction towards the uphole face. A downhole section of the radial profile of each of the rotor projections 62 also tapers in the downhole direction towards the downhole end, such that the width of the end face 92 gets narrower towards the downhole end. The width of the end face 92 is therefore widest at a point in between the uphole end and the downhole end of the rotor projections 62 and the width of the end face 92 tapers from this widest point in both the uphole and downhole directions. Each rotor projection 62 is longitudinally extended and tapers radially in the downhole direction, such that the radial thickness of the uphole end is greater than the radial thickness of the downhole end giving the rotor projections 62 a wedge like shape.

In a maximally open position as shown in FIG. 5, rotor flow channels 63 defined by the side faces 67 of adjacently positioned rotor projections 62 align with and are in fluid communication with the stator flow channels 43, so that mud flows freely through the flow channels 43, 63 resulting in no pressure pulse. The rotor flow channels 63 are curved or rounded at the proximal end closest to the rotor body 61 for smooth flow of mud therethrough which may beneficially reduce wear of the rotor projections 42. The rotor projections 62 each align with one of the stator projections 42. The uphole face of each rotor projection 62 is narrower than the downhole face 45 of the aligned stator projection 42 and the rotor projections 62 are not centrally positioned with respect to the stator projections 42; instead an axial central line of the rotor projections 62 is circumferentially offset from an axial central line of the stator projections 42.

To generate the maximum amplitude pressure pulse, the rotor 60 rotates from the open position 30 degrees counterclockwise to a full restricted flow position as shown in FIG. 6(*b*). In the full restricted flow position, the rotor projections 62 align with the stator flow channels 43 and flow of mud through the stator flow channels 43 is restricted generating a pressure pulse of maximum amplitude. The rotor 60 then rotates 30 degrees clockwise back to the open position.

To generate the intermediate amplitude pressure pulse, the rotor 60 rotates from the open position 30 degrees clockwise to the partial restricted flow position as shown in FIG. 6(*b*). In the partial restricted flow position, the rotor projections 62 partially align with the stator flow channels 43. A gap 52 between the stator projections 42 and the rotor projections 62 allows some mud to flow from the stator flow channels 43 to the rotor flow channels 63, however the flow of mud through the stator flow channels 43 is partially restricted by the rotor projections 62 thereby generating a pressure pulse. The rotor then rotates 30 degrees counter-clockwise back to the open position. As the partial restricted flow position allows more mud to flow through than the full restricted flow position, the amplitude of the pressure pulse in the partial restricted flow position will be smaller than the amplitude of the pressure pulse in the full restricted flow position, i.e. the intermediate amplitude pressure pulse has a smaller amplitude than the maximum amplitude pressure pulse.

To generate the intermediate and maximum amplitude pressure pulses, the rotor 60 is rotated an equal span of rotation (i.e. 30 degrees) from the open position clockwise to the partial restricted flow position and from the open position counter-clockwise to the full restricted flow position. The fluid pressure pulse generator 30 is therefore able to generate pressure pulses with different pulse amplitudes through equal or symmetrical rotation of the rotor 60 in the clockwise and counter-clockwise direction from the open position.

Calibration Sweep Program

The memory in the electronics subassembly 28 comprises a calibration sweep program that is executable by the processor to perform a calibration sweep operation, which comprises measuring the fluid pressure at multiple incremental positions of the motor across the rotor's rotational range, then assigning a rotor positional value to each incremental motor position based on the fluid pressure measured at that position. The calibration sweep operation can be performed whenever the rotor 60 is detected to be misaligned, or from to time to time to ensure that the rotor 60 is in proper alignment. The calibration sweep operation is carried out when drilling fluid is being pumped downhole under pressure.

The calibration sweep operation can be performed on both the first and second embodiments of the pressure pulse generator 30, i.e. on both the single and dual amplitude pressure pulse generators 30. A pressure sweep operation performed on the single amplitude pulse generator is shown in FIG. 8, and a pressure sweep operation performed on the dual amplitude pulse generator is shown in FIG. 9.

Figure 8:
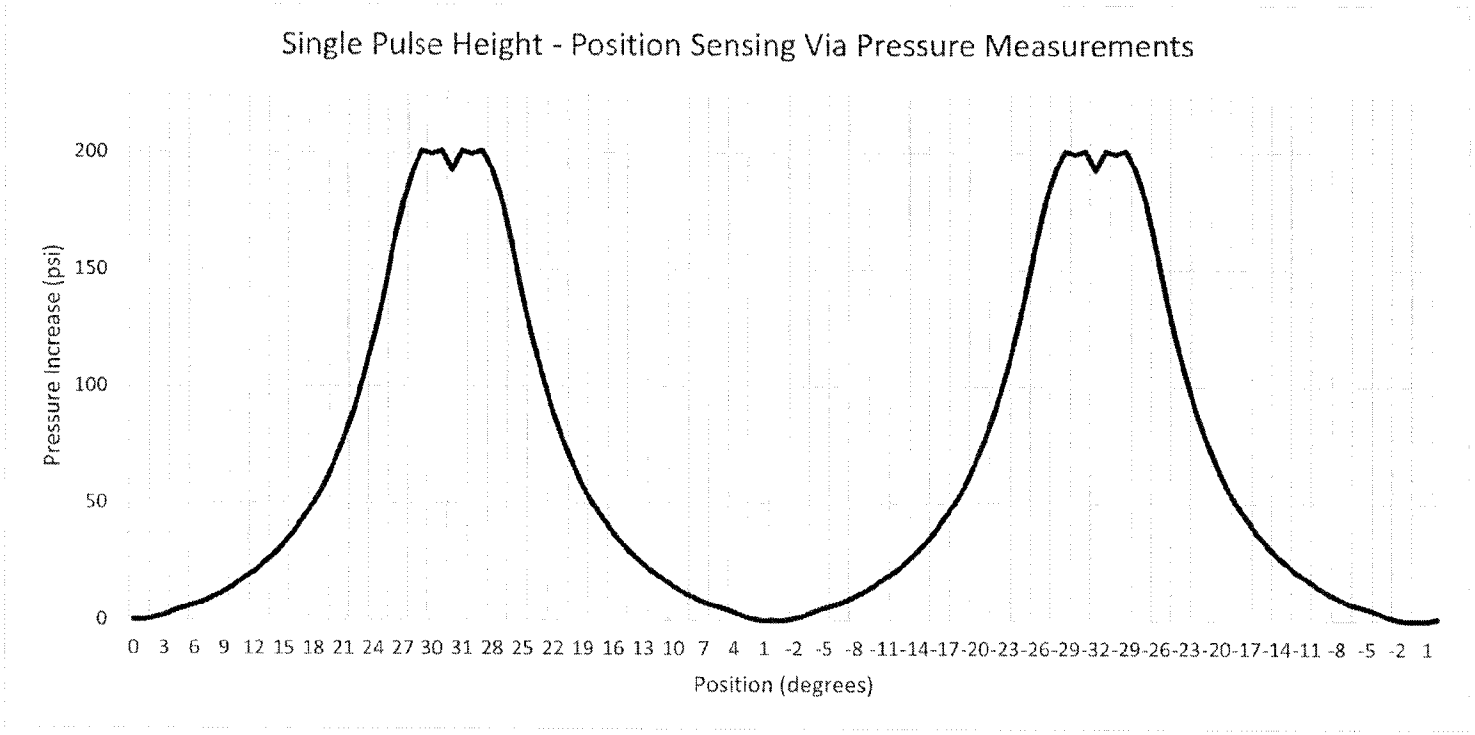
FIG. 8 is a rotor position map of the rotor in the first embodiment of the fluid pressure pulse generator operating in a dual oscillating mode, which shows measured fluid pressures over the rotor's rotational range taken during a calibration sweep operation.
Figure 9:
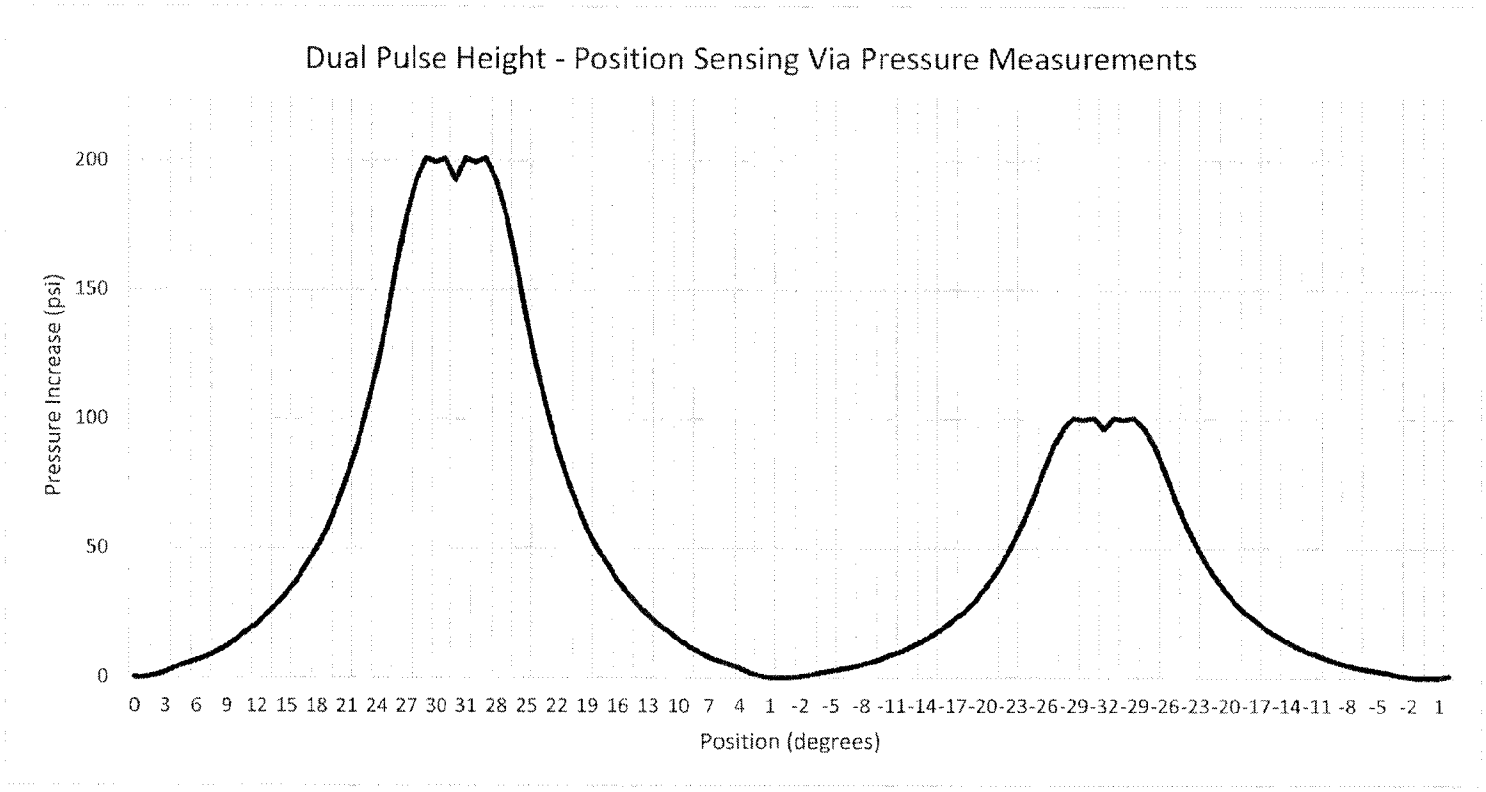
FIG. 9 is a rotor position map of the rotor in the second embodiment of the fluid pressure pulse generator operating in a dual oscillating mode, which shows measured fluid pressures over the rotor's rotational range taken during a calibration sweep operation.

In FIGS. 8 and 9, the calibration sweep operation is applied to respective single and dual amplitude pulse generators 30 that are configured to operate in a dual direction oscillation mode across a rotational range of +/−30 degrees. When the processor executes the calibration sweep program, the motor is rotated through a series of rotational increments across the rotational range of the rotor 60 and the readings from the pressure transducer 34 are taken at each of these increments. The number of increments will depend on the position sensing resolution of the motor; some known motor designs comprise a Hall sensor in the motor which when coupled to 50:1 gearbox, for example, can provide a 0.6 degree resolution and which can thus identify 0.6 degree (or multiples thereof) rotational increments of the rotor.

Figure 10:
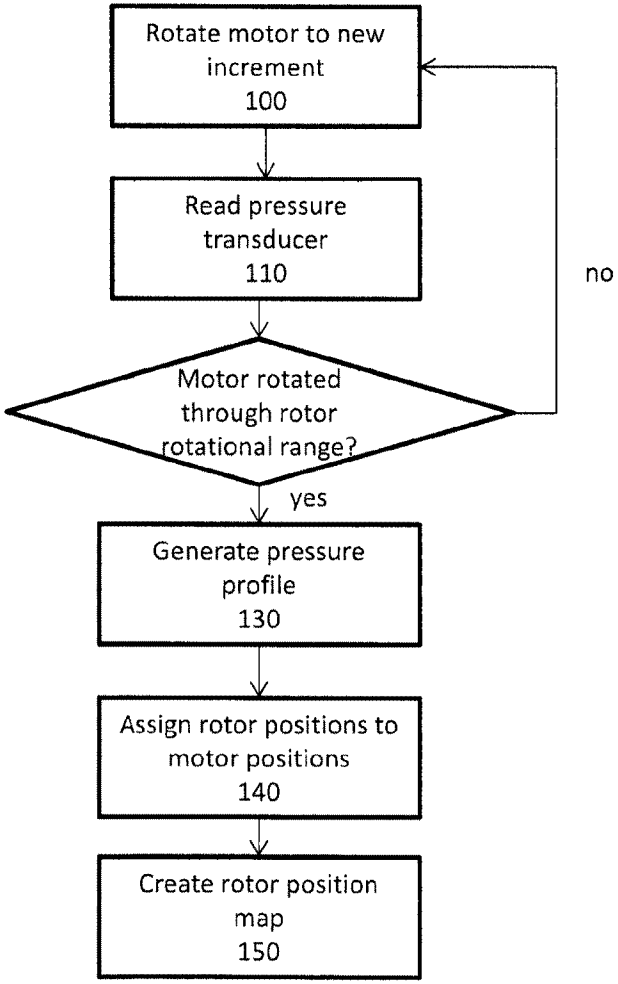
FIG. 10 is a flow chart showing steps performed during a calibration sweep operation by a processor of the downhole telemetry tool executing a calibration sweep program.

Referring to FIG. 10, after the motor is rotated to each new rotational increment (step 100), the motor is paused for a sufficient time period for the pressure transducer 34 to take a pressure reading at that rotational position (step 110). When the pressure reading has been taken, the motor is then advanced to the next rotational increment, and the pressure measurement is taken again. Since in this embodiment, the pulse generator is operating in a dual oscillation mode, the rotor is rotated through 30 degrees in both a clockwise and counter-clockwise direction in order to rotate the rotor 60 through its entire rotational range.

When the motor has rotated the rotor 60 though its rotational range, the processor compiles the measured pressures and corresponding motor positions to produce a measured fluid pressure profile (step 130), which should feature two pulses of equal amplitude corresponding to the restricted flow position in each of the clockwise and counter-clockwise directions for the single amplitude pulse generator, and two pulses of different amplitudes corresponding to the full restricted flow position in one direction and a partial restricted flow position in the opposite direction for the dual amplitude pulse generator. For the single amplitude pulse generator, the processor then identifies the peaks and valleys in the profile and assigns a 0 degree rotor position to the motor position corresponding to the lowest pressure (wherein the 0 degree rotor position corresponds to the fully opened position of the rotor 60) and +30 and −30 degree rotor positions to the motor positions corresponding to the peaks of the two pulses. For the dual amplitude pulse generator, the processor similarly identifies the peaks and valleys in the profile and assigns a 0 degree rotor position to the motor position corresponding to the lowest measured pressure, a +30 degree rotor position to the motor position corresponding to the highest peak, and a −30 degree rotor position to the motor position corresponding to the intermediate peak (note: these assignments relate to an embodiment where the highest amplitude pulse is in the positive rotational direction and the intermediate amplitude pulse is the negative rotational direction). The processor then extrapolates between these assigned positions to assign rotor positions to the remaining motor positions (step 140). Then, the measured pressure profile along with the assigned rotor positions are stored in a rotor position map (Step 150).

FIG. 8 shows a rotor position map of the single amplitude pulse generator and FIG. 9 shows a rotor position map of the dual amplitude pulse generator. In order to ensure that the peak of each pulse is detected the calibration sweep program can be further programmed to cause the motor to advance slightly past the expected rotational range limit of the rotor 60, which in the embodiment shown in FIGS. 8 and 9, is 2 degrees, to 32 and −32 degrees respectively, before changing directions and returning back to the 0 degree position.

Since each motor position is now associated with a rotor position, the rotor position map provides a means for determining the rotational position of the rotor 60 during normal telemetry operation without the use of position sensors on the output side of the motor gearbox. That is, when telemetry data is being encoded into a mud pulse telemetry signal, the processor will instruct the motor to rotate to motor positions that correspond to the rotor positions required to produce the pressure pulse pattern representing the telemetry signal, per the rotor position map, and without the need to read position sensors on the output side of the motor.

Reverse Pulse Detection Program

Figure 11:
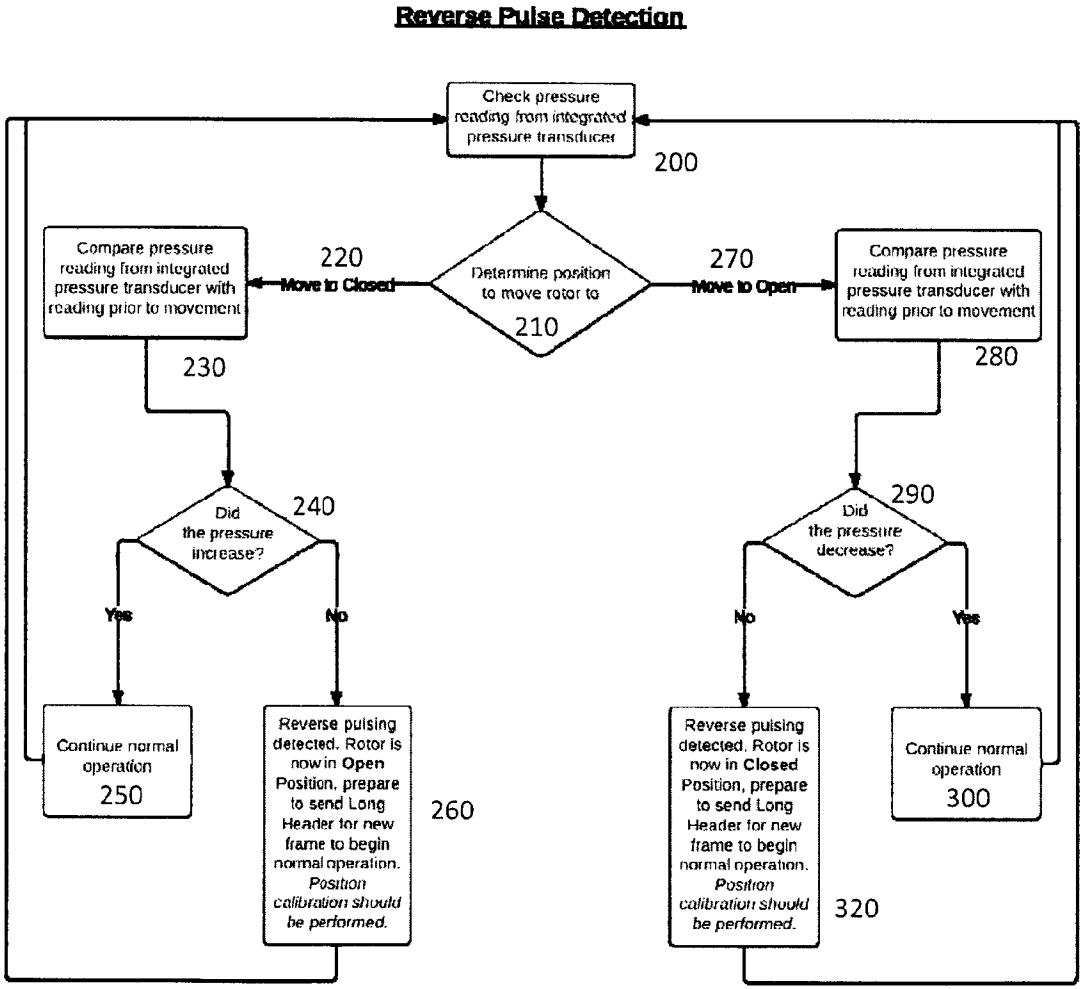
FIG. 11 is a flow chart of steps performed by a reverse pulse detection program executed by the processor according to another embodiment.
Figure 12:
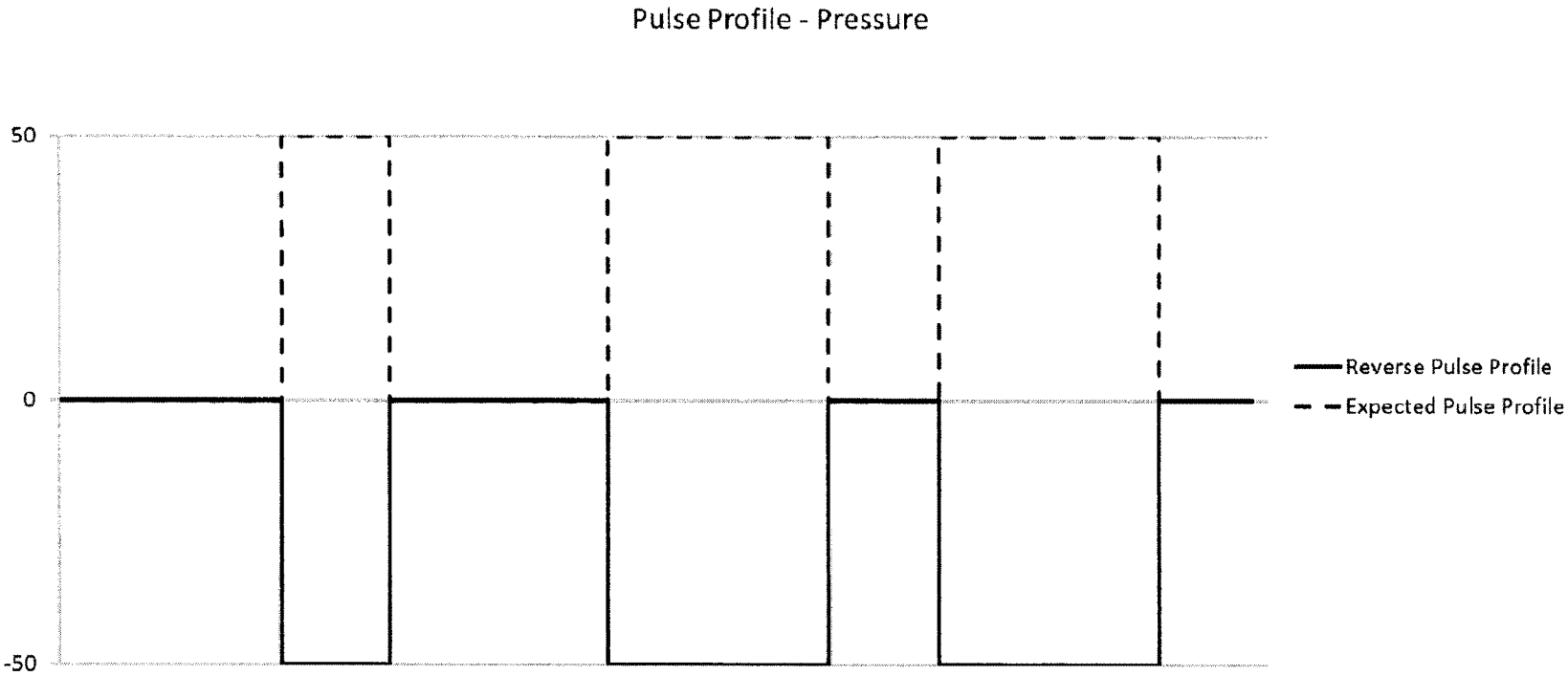
FIG. 12 is a schematic illustrating an expected pulse profile and a reverse pulse profile of fluid pulses produced by the downhole telemetry tool.
Figure 13A:
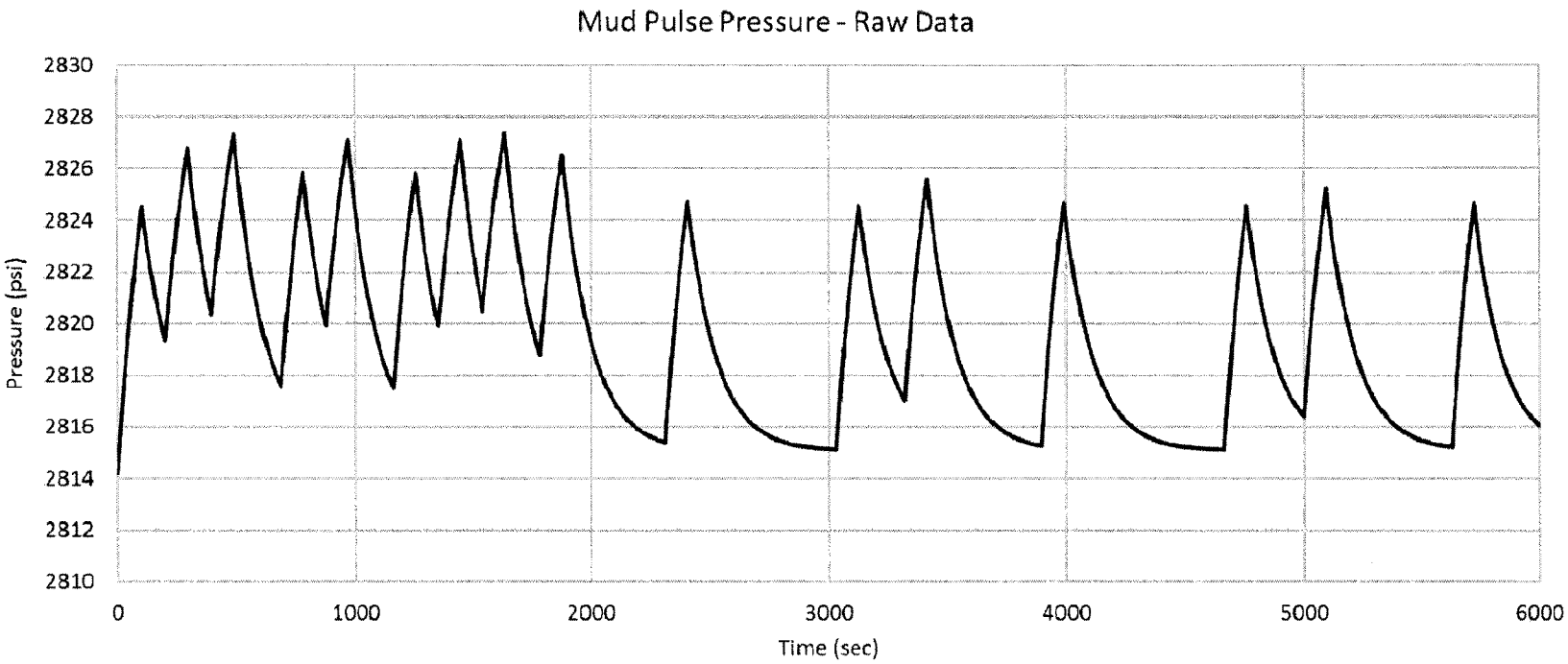
FIGS. 13(*a*) and (*b*) are pressure-time graphs of a mud pulse telemetry signal generated by the fluid pressure pulse generator, wherein FIG. 13(*a*) represents an expected pulse pattern of the telemetry signal, and FIG. 13(*b*) represents is a measured pulse patterned of the telemetry signal, indicating a reverse pulse condition.
Figure 13B:
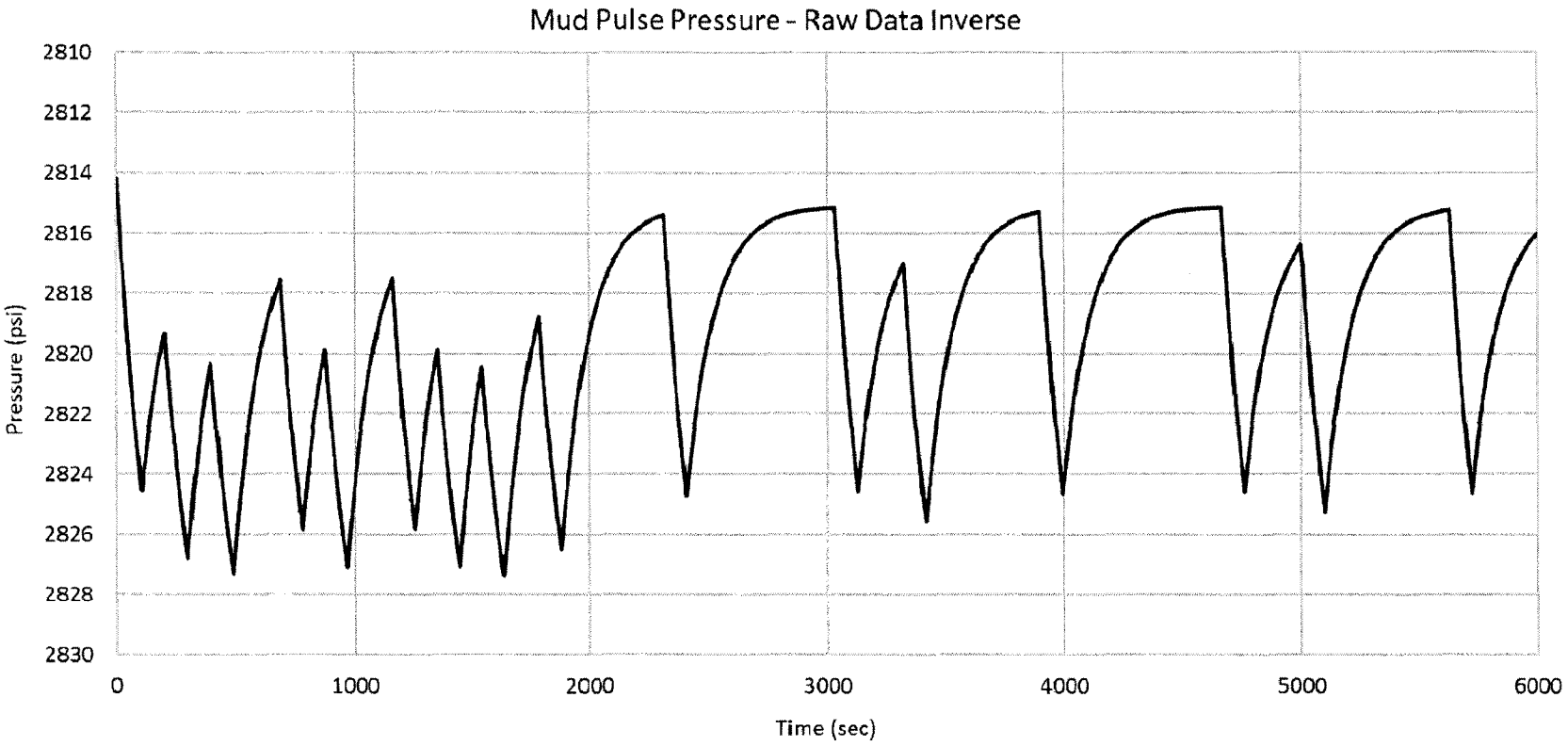

Referring now to FIGS. 11 to 13, the downhole telemetry tool 20 can execute a reverse pulse detection program to determine if the rotor 60 is misaligned and requires recalibration. Like the calibration sweep program, the reverse pulse detection program is executed when the drilling fluid is pressurized and whether or not the drill string is drilling.

As can be seen in FIG. 11, the processor first reads the motor position and determines the corresponding rotor position from the rotor position map ("first rotor position"), then reads pressure measurements from the pressure transducer 34 to determine the mud pressure at the first rotor position ("first pressure reading", step 200). Depending on the first rotor position, the processor can decide to move the rotor 60 towards the fully opened flow position or towards the maximum restricted flow position (or the intermediate restricted flow position if the dual amplitude pulse generator is used) (step 210). For example, if the first rotor position is at or near the fully opened flow position then the processor will instruct the motor to rotate the rotor 60 towards the restricted flow position ("second rotor position", step 220). Then, the pressure transducer 34 is read again ("second pressure reading") and the pressure reading is compared to the first pressure reading (step 230, FIG. 12). The processer then determines whether the pressure increased as expected (step 240); if yes, the pulser assembly is operating as expected (see FIG. 13(*a*)) and the processor records a condition normal state and returns the downhole telemetry tool 20 back to normal telemetry operation (step 250). If instead the pressure decreased, the rotor 60 did not close as expected and instead was moved towards the fully opened position, and the processor records a reverse pulsing condition indicating that the rotor 60 is misaligned (step 260, see FIG. 13(*b*)). The processor can communicate the reverse pulsing condition in a long header portion 70 from the next message frame of a telemetry signal that is transmitted to surface. Upon receipt of this long header portion, the operator will be made aware of the reverse pulse condition wherein the message data 72 received at surface cannot be properly decoded.

When a reverse pulse condition is detected the processor can optionally execute the calibration sweep program to perform the aforementioned calibration sweep operation to realign the rotor 60. Alternatively, other known calibration means can be employed to realign the rotor 60, including using position sensors if such sensors exist in the tool 20. Once the rotor 60 has been realigned, the reverse pulse condition should have been corrected, and telemetry signal received at surface should be decodable, and will include a long header portion that is read at surface to ensure that the surface equipment is properly synchronized.

If instead at step 200 the first rotor position is determined to be at or near the maximum restricted flow position, the processor will instruct the motor to rotate the rotor towards the fully opened position (step 270). Then, the pressure transducer 34 is read again and the pressure reading is compared to the first pressure reading (step 280). The processer then determines whether the pressure decreased as expected (step 290); if yes, then the processor records a condition normal state and returns the downhole telemetry tool 20 back to normal telemetry operation (step 300). If instead the pressure increased, the rotor 60 did not open as expected and instead was moved into a more restricted flow position, and the processor records a reverse pulsing condition indicating that the rotor is misaligned (step 310). The processor can communicate the reverse pulsing condition in a long header portion from the next message frame of a telemetry signal, and execute the calibration sweep program or other known calibration techniques to realign the rotor 60.

The reverse pulse detection program can be continuously executed during normal operation, wherein the processor is continuously measuring the pressure transducer readings as the rotor 60 moves back and forth by the set +/−30 degree oscillation, determining if the measured pressure is increasing or decreasing between the start and end positions of an oscillation, and then comparing the measured increase or decrease to the expected pressure change to determine if a reverse pulse condition exists.

Alternatively, the reverse pulse detection program can be executed at a predetermined point during a frame, i.e. at a predetermined position of the rotor 60 during its oscillation, such as the halfway point of the oscillation. In this alternative embodiment, the processor moves the rotor 60 a relatively small increment (e.g. 3-5 degrees) towards the restricted flow position. The processor then reads the pressure transducer 34 and determines whether the pressure has increased as expected; if the pressure did not increase as expected, the processor records a reverse pulse condition. Conversely, the processor can be moved a small increment towards the fully opened position, in which case the processor is expected to read a pressure decrease, and will record a reverse pulse condition if the pressure reading is not what was expected.

According to another embodiment, the processor can execute a method for determining whether the rotor is out of alignment and requires a realignment, and the reverse pulse detection program is modified accordingly to execute this method. In this embodiment, the reverse pulse detection program is programmed to move the rotor 60 from a first rotor position having an expected first pressure towards a second expected rotor position having a second expected pressure. The pressure transducer is read at these two rotor positions and compared to the expected pressures at these two rotor positions stored on the rotor position map. If there is no difference between the measured pressure and the expected pressure, then the rotor is determined to in alignment. If there is a difference between the measured and expected pressures that is within an acceptable range, then the rotor 60 is considered to be misaligned but not requiring realignment. The acceptable range can correspond to rotor positions that produce an acceptable quality of the data transmission, e.g. a data transmission that can be decoded at surface under normal operating conditions. If the difference between the measured and expected pressures is outside the selected range, the rotor 60 is considered to be misaligned and requiring realignment.

For example and referring to FIG. 8, the processor can be programmed to move the rotor 60 from a first rotor position having an expected rotor position of 0 degrees and an expected pressure of 0 psi (i.e. a fully opened flow position), to the second rotor position having an expected rotor position of 30 degrees and an expected pressure of 200 psi (i.e. a maximum restricted flow position). The selected range in this example is at least 30% of the expected pulse height of 200 psi, i.e. a pressure rise of at least 80 psi. If the measured pressure difference between the first and second rotor position is a 120 psi pressure rise, the processor concludes that the rotor 60 is misaligned (by about 5 degrees) but the misalignment is not bad enough to require the rotor 60 to be realigned, i.e. the pulser assembly can still produce a decodable telemetry signal. If instead the measured pressure difference is a 120 psi pressure drop, the processor concludes that the rotor 60 is misaligned (by about 25 degrees) and requires realignment. In such a case, the processor is programmed to record a reverse pulse condition and send a message to the surface operator in the header portion of the next telemetry signal, then execute the calibration sweep program to realign the rotor 60.

Figure 14:
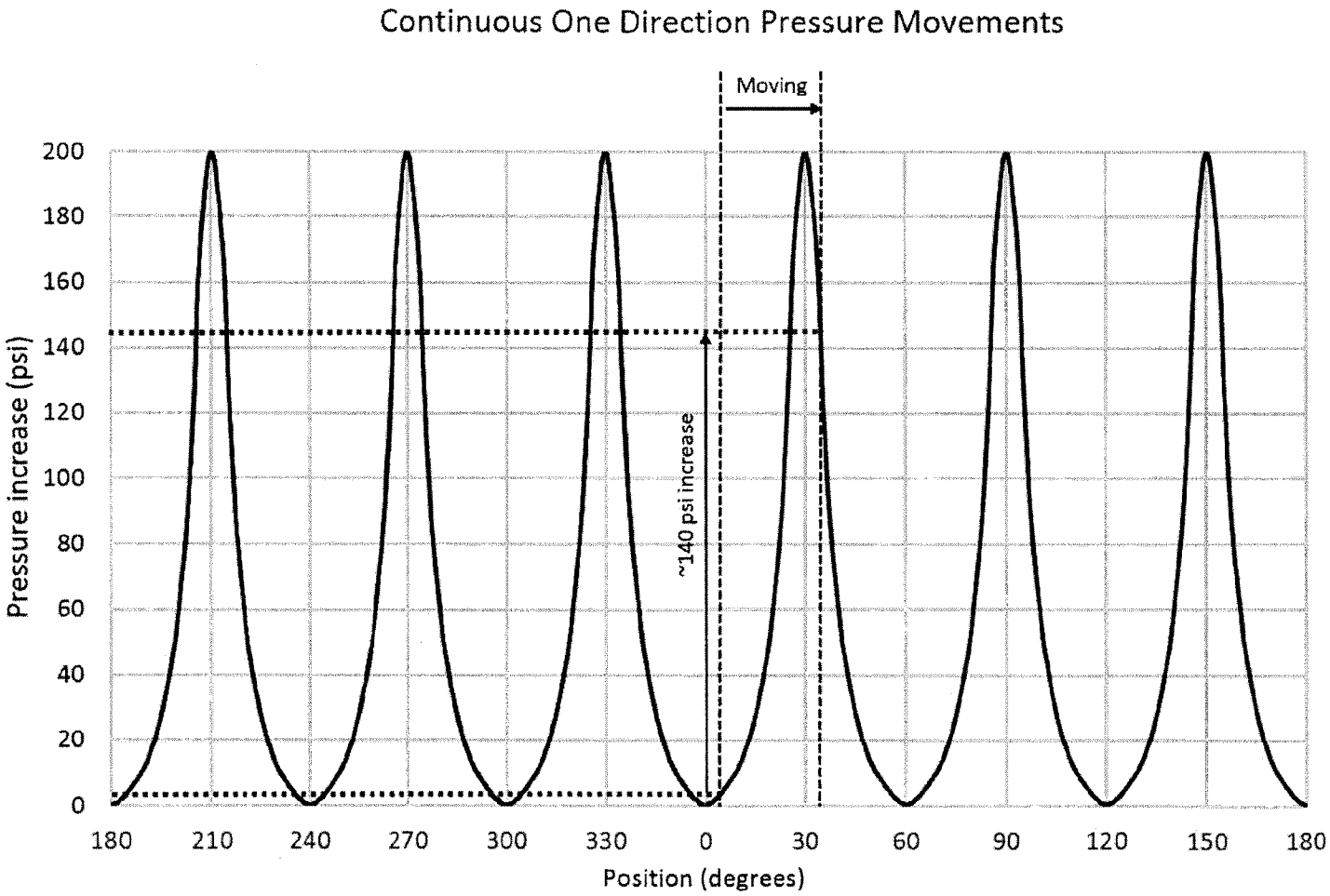
FIG. 14 is rotor position map of the rotor of the first embodiment of the fluid pressure pulse generator, operating in a single direction mode, and illustrating a method of detecting a misalignment of the rotor according to another embodiment.

According to yet another embodiment and referring to FIG. 14, the processor can be programmed to determine when the rotor 60 is misaligned and requires a realignment, by detecting a momentary pressure rise beyond a selected threshold. This embodiment is particularly useful when the pulser assembly is not provided with a mechanical stop that limits the rotor 60 to rotate within a defined oscillation range, and the rotor 60 is able to rotate continuously in one direction. In this case, the processor is programmed to move the rotor 60 into a first rotor position that is expected to correspond to the fully opened flow position, then to a second rotor position that is expected to correspond to the maximum restricted flow position; this movement of the rotor 60 is expected to produce a continuous pressure rise from the lowest expected pressure to the highest expected pressure. The processor is also programmed to take continuous pressure measurements while the rotor 60 is being rotated. Should the measured pressure drop after peaking, this suggests that the rotor is misaligned, and has "overshot" the maximum restricted flow position. By way of example and as shown in FIG. 14, the expected rotor position is 0 degrees and the expected pressure is 0 psi when the rotor 60 is at the fully opened flow position, and the expected rotor position is 30 degrees and the expected pressure is 200 psi when the rotor 60 is at the maximum restricted flow position. If instead, the first rotor position is at 5 degrees and the second rotor position is at 35 degrees, the measured pressure will rise from about 5 psi, peak at 200 psi, then drop to about 145 psi, resulting in a net pressure change of +140 psi. The pressure spike will thus be about 55 psi higher than the measured pressure at the second rotor position, and the processor is programmed to associate such a pressure spike as an indication that the rotor 60 is misaligned. The processor can be further programmed to execute the calibration sweep operation or another realignment operation when the detected pressure spike exceeds a selected threshold. The selected threshold can correspond to a minimum acceptable quality of the data transmission.

While particular embodiments have been described in the foregoing, it is to be understood that other embodiments are possible and are intended to be included herein. It will be clear to any person skilled in the art that modifications of and adjustments to the foregoing embodiments, not shown, are possible.

The invention claimed is:

1. A method for determining a rotational position of a rotor in a fluid pressure pulse generator of a downhole telemetry tool, comprising:

(a) for at least one rotational position of the rotor, determining an expected pressure of a drilling fluid at the fluid pressure pulse generator that corresponds to the at least one rotational position;

(b) forming a rotor position map of rotor rotational positions and corresponding expected drilling fluid pressures from the at least one rotational position of the rotor and the corresponding determined expected pressure;

(c) measuring a pressure of the drilling fluid at the fluid pressure pulse generator, and determining a first rotational position of the rotor at the measured pressure by associating the measured pressure to an expected pressure and corresponding rotor rotational position in the rotor position map;

(d) rotating the rotor to a second rotational position, then measuring the pressure of the drilling fluid at the second rotational position; and (i) identifying a rotor misaligned condition when the measured drilling fluid pressure change between the first and second rotational positions deviates beyond a selected threshold from the expected drilling fluid pressure change between the first and second rotational positions; or (ii) identifying a reverse pulse condition when: (1) rotating the rotor to the second rotational position comprises rotating the rotor towards a fully opened position, and the measured drilling fluid pressure increases from the first to the second rotational positions; or (2) rotating the rotor to the second rotational position comprises rotating the rotor towards a maximum restricted flow position, and the measured drilling fluid pressure decreases from the first to the second rotational positions.

2. A method as claimed in claim 1 wherein the at least one rotational position comprises a fully opened flow position and the corresponding expected pressure is the lowest pressure generated by the fluid pressure pulse generator.

3. A method as claimed in claim 1 wherein the at least one rotational position comprises a maximum restricted flow position and the corresponding expected pressure is the highest pressure generated by the fluid pressure pulse generator.

4. A method as claimed in claim 1 wherein the method further comprises rotating the rotor towards a second rotor position that is expected to increase drilling fluid flow thereby reducing the expected pressure of the drilling fluid, then measuring the pressure of the drilling fluid at the second rotor position and identifying a rotor misalignment when the measured pressure at the second rotor position is not lower than the measured pressure at the first rotor position.

5. A method as claimed in claim 1 wherein the method further comprises rotating the rotor towards a second rotor position that is expected to decrease drilling fluid flow thereby increasing the expected pressure of the drilling fluid, then measuring the pressure of the drilling fluid at the second rotor position and identifying a rotor misalignment when the measured pressure at the second rotor position is not higher than the measured pressure at the first rotor position.

6. A method as claimed in claim 4 wherein the fluid pressure pulse generator is a single amplitude pulse generator configured to operate in a dual direction oscillation mode, and the fluid pressure profile comprises pulses of the same amplitude.

7. A method as claimed in claim 4 wherein the fluid pressure pulse generator is a dual amplitude pulse generator configured to operate in a dual direction oscillation mode, and the fluid pressure profile comprises at least two pulses of different amplitudes.

8. A method as claimed in claim 1 wherein the method further comprises rotating the rotor towards a second rotor position that is expected to correspond to a maximum restricted flow position and produce a maximum drilling fluid pressure, then measuring the drilling fluid pressure as the rotor is rotated between the first and second rotor positions, and identifying a rotor misalignment when the measured pressure at the second rotor position is lower than the maximum drilling fluid pressure by a selected threshold.

9. A method as claimed in claim 1 further comprising performing a calibration sweep operation to align the rotor with a motor coupled to the rotor when the rotor misalignment has been identified, the calibration sweep operation comprising:

(a) rotating the motor through multiple incremental motor rotational positions and measuring the drilling fluid pressure at each incremental motor position thereby defining a fluid pressure profile across the multiple incremental motor positions;

(b) determining a rotor rotational position corresponding to the measured drilling fluid pressure at each incremental motor rotational position, wherein the determined rotor rotational position is the expected rotor rotational position that produces the measured drilling fluid pressure; and (c) updating the rotor position map with the determined rotational positions and corresponding drilling fluid pressures and incremental motor rotational positions.

10. A method for determining a rotor misaligned condition in a fluid pressure pulse generator of a downhole telemetry tool, the method comprising:

(a) generating fluid pressure pulses of a known pulse pattern;

(b) measuring a drilling fluid pressure at a first selected rotor position and a second selected rotor position in the known pulse pattern; and (c) identifying a rotor misaligned condition when the measured drilling fluid pressure change between the first and second selected rotor positions deviates beyond a selected threshold from an expected drilling fluid pressure change between the first and second rotational positions.

11. A method for determining a reverse pulse condition in a fluid pressure pulse generator of a downhole telemetry tool, the method comprising:

(a) measuring a drilling fluid pressure in the fluid pressure pulse generator when a rotor of the fluid pressure pulse generator is at a first rotor position;

(b) rotating the rotor towards a fully opened position or towards a maximum restricted position until the rotor reaches a second rotor position, (c) measuring the fluid pressure in the fluid pressure pulse generator at the second rotor position; and (d) identifying a reverse pulse condition when (i) the measured fluid pressure increases from the first to second rotor positions when the rotor is rotated towards the fully opened position; or (ii) when the measured pressure decreases from the first to second rotor positions when the rotor is rotated towards the maximum restricted position.

12. A method as claimed in claim 10 further comprising performing a calibration sweep operation to align the rotor with a motor coupled to the rotor when the reverse pulse condition or the motor misaligned condition has been identified, the calibration sweep operation comprising:

(a) rotating the motor through multiple incremental motor rotational positions and measuring the drilling fluid pressure at each incremental motor position thereby defining a fluid pressure profile across the multiple incremental motor positions;

(b) determining a rotor rotational position corresponding to the measured drilling fluid pressure at each incremental motor rotational position, wherein the determined rotor rotational position is the expected rotor rotational position that produces the measured drilling fluid pressure; and (c) updating the rotor position map with the determined rotational positions and corresponding drilling fluid pressures and incremental motor rotational positions.

13. A downhole telemetry tool, comprising:

(a) a motor;

(b) a fluid pressure pulse generator comprising a stator and a rotor coupled to the motor and rotatable relative to the stator;

(c) a pressure transducer configured to measure a pressure of a drilling fluid at the pulse generator; and (d) an electronics subassembly communicative with the motor and the pressure transducer, and comprising a processor and a memory having program code encoded thereon that is executable by the processor to determine a position of the rotor, by (i) for at least one rotational position of the rotor, determining an expected pressure of a drilling fluid at the fluid pressure pulse generator that corresponds to the at least one rotational position;

(ii) forming a rotor position map of rotor rotational positions and corresponding expected drilling fluid pressures from the at least one rotational position of the rotor and the corresponding determined expected pressure; and (iii) reading a pressure measurement from the pressure transducer, and determining a first rotational position of the rotor at the pressure measurement by associating the pressure measurement to an expected pressure and corresponding rotor rotational position in the rotor position map;

(iv) rotating the rotor to a second rotational position, then measuring the pressure of the drilling fluid at the second rotational position; and (i) identifying a rotor misaligned condition when the measured drilling fluid pressure change between the first and second rotational positions deviates beyond a selected threshold from the expected drilling fluid pressure change between the first and second rotational positions; or (ii) identifying a reverse pulse condition when: (1) rotating the rotor to the second rotational position comprises rotating the rotor towards a fully opened position, and the measured drilling fluid pressure increases from the first to the second rotational positions; or (2) rotating the rotor to the second rotational position comprises rotating the rotor towards a maximum restricted flow position, and the measured drilling fluid pressure decreases from the first to the second rotational positions.

14. A downhole telemetry tool as claimed in claim 13 wherein a fully opened rotor position is determined to correspond to a pressure measurement value that is the lowest in the fluid pressure profile.

15. A downhole telemetry tool as claimed in claim 14 wherein and a maximum restricted rotor position is determine to correspond to a pressure measurement value that is the highest in the fluid pressure profile.

16. A downhole telemetry tool as claimed in claim 15 wherein the pulse generator is a single amplitude pulse generator configured to operate in a dual direction oscillation mode, and the fluid pressure profile comprises at least two pulses of the same amplitude.

17. A downhole telemetry tool as claimed in claim 15 wherein the pulse generator is a dual amplitude pulse generator configured to operate in a dual direction oscillation mode, and the fluid pressure profile comprises at least two pulses of different amplitudes.

* * * * *